US010299562B2

(12) United States Patent
Takahashi

(10) Patent No.: US 10,299,562 B2
(45) Date of Patent: May 28, 2019

(54) APPLICATOR

(71) Applicant: WINTRADING CO., LTD, Saitama (JP)

(72) Inventor: Hiroaki Takahashi, Saitama (JP)

(73) Assignee: WINTRADING CO., LTD., Saitama (JP)

( * ) Notice: Subject to any disclaimer, the term of this patent is extended or adjusted under 35 U.S.C. 154(b) by 0 days.

(21) Appl. No.: 15/373,704

(22) Filed: Dec. 9, 2016

(65) Prior Publication Data

US 2017/0202337 A1 Jul. 20, 2017

(30) Foreign Application Priority Data

Jan. 19, 2016 (JP) ..... 2016-7740
May 11, 2016 (JP) ..... 2016-95306

(51) Int. Cl.
*B43K 8/08* (2006.01)
*A45D 34/04* (2006.01)
*A45D 19/00* (2006.01)

(52) U.S. Cl.
CPC ..... *A45D 34/04* (2013.01); *A45D 19/00* (2013.01); *B43K 8/08* (2013.01)

(58) Field of Classification Search
CPC ..... B43K 8/06; B43K 8/08
USPC ..... 401/196, 198, 199, 202, 205, 206, 141, 401/142
See application file for complete search history.

(56) References Cited

U.S. PATENT DOCUMENTS 4,157,874 A * 6/1979 Durand ..... B43K 5/1845 101/470
5,249,875 A * 10/1993 Hori ..... B05B 11/0035 401/141
5,967,687 A * 10/1999 Oike ..... B43K 8/04 401/151

FOREIGN PATENT DOCUMENTS

| | | |
|---|---|---|
| JP | 47-047410 | 11/1972 |
| JP | 59-000016 | 1/1984 |
| JP | 11-48678 | 2/1999 |
| JP | 11-301168 | 11/1999 |
| JP | 2001-080277 | 3/2001 |
| JP | 2004-344858 | 12/2004 |
| JP | 2013-102910 | 5/2013 |
| JP | 2014-188969 | 10/2014 |

* cited by examiner

*Primary Examiner* — David Walczak
*Assistant Examiner* — Joshua Wiljanen
(74) *Attorney, Agent, or Firm* — Wenderoth, Lind & Ponack, L.L.P.

(57) ABSTRACT

An applicator that causes a liquid applying material accumulated inside, for example, a cosmetic tool, such as an eye liner and an eyebrow pencil, or a gray-hair partially dyeing tool for hair, an eyebrow, or a similar part, to infiltrate into an application portion to use this liquid applying material for application or drawing from a distal end application portion.

15 Claims, 8 Drawing Sheets

RESULT OF SWING INSPECTION AFTER LIQUID FILLING

FIG. 8A

BULK A (BLACK) VISCOSITY: 6.0CP (CENTIPOISE)

NUMBER OF TIMES UP TO LIQUID LEAKAGE

| | NO COMPRESSION MEMBER | 4-MM COMPRESSION MEMBER | 5.5-MM COMPRESSION MEMBER |
|---|---|---|---|
| SAMPLE 1 | 6 | 8 | 12 |
| SAMPLE 2 | 6 | 7 | 11 |
| SAMPLE 3 | 5 | 9 | 13 |

FIG. 8B

BULK B (BROWN) VISCOSITY: 5.0CP (CENTIPOISE)

NUMBER OF TIMES UP TO LIQUID LEAKAGE

| | NO COMPRESSION MEMBER | 4-MM COMPRESSION MEMBER | 5.5-MM COMPRESSION MEMBER |
|---|---|---|---|
| SAMPLE 1 | 4 | 6 | 9 |
| SAMPLE 2 | 4 | 7 | 9 |
| SAMPLE 3 | 4 | 6 | 10 |

APPLICATOR

TECHNICAL FIELD

The present invention relates to an applicator that causes a liquid applying material accumulated inside, for example, a cosmetic tool, such as an eye liner and an eyebrow pencil, or a gray-hair partially dyeing tool for hair, an eyebrow, or a similar part, to be infiltrate into an application portion to use this liquid applying material for application or drawing from a distal end application portion.

BACKGROUND ART

Conventionally, there has been generally known an applicator (see FIG. 4) such as an eye liner that internally accumulates a liquid applying material. The applicator includes an application member formed of a core material made of a fiber member or a similar member to absorb and infiltrate the liquid applying material. The applicator applies or draws the liquid applying material with a distal end application portion of this application portion.

To adjust an amount of bulk output of the liquid applying material accumulated inside, these applicators usually include an absorbing body 7 to cover the core material. This absorbing body 7 has been made to be adjusted the amount of output of a liquid applying material 6 delivered to the core material.

Conventionally, as illustrated in FIG. 4, this absorbing body 7 is typically manufactured with a resin molded product whose outer peripheral surface is formed into an uneven surface in an accordion shape. Designing the resin molded product has required many adjustments and has required a high cost for the mold.

A region of a storage 12 to internally accumulate the liquid applying material is fixed; therefore, this region was not able to be changed (see FIG. 4).

The liquid applying materials 6 have a large number of different viscosities and materials depending on an aspect for use. An amount of accumulation of the liquid applying material 6 accumulated in the storage 12 also variously differs.

Accordingly, as described above, it has been regarded as difficult to use the applicator and the internal absorbing body 7 that handle the plurality of kinds of the liquid applying materials 6 and have a structure with identical shape and identical size including the cases of different amounts of accumulation.

That is, the following problems occur. Separately manufacturing the absorbing bodies 7 made of the resin molded products whose length or a similar dimension is changed requires the high cost for the mold. Changing the amount of accumulation requires a change in the size of the applicator itself.

The liquid applying materials 6 have a large number of different viscosities and materials depending on the aspect for use. The amount of accumulation of the liquid applying material 6 accumulated in the storage 12 also variously differs.

Accordingly, as described above, it has been regarded as difficult to use the applicator and the internal absorbing body 7 that handle the plurality of kinds of the liquid applying materials 6 and have a structure with identical shape and identical size including the cases of different amounts of accumulation.

That is, the following problems occur. Separately manufacturing the absorbing bodies 7 made of the resin molded products whose length or a similar dimension is changed requires the high cost for the mold. Changing the amount of accumulation requires the change in the size of the applicator itself.

The region for the storage 12 to internally accumulate the liquid applying material is fixed; therefore, this region was not able to be changed (see FIG. 4).

Viscosity of the bulk differs depending on a kind of bulk liquid. Changing the shape of the applicator so as not to cause a liquid leakage according to the bulk liquid with different viscosities results in an extreme cost increase and is therefore utterly unacceptable.

Accordingly, applicators that can employ an applicator of identical standard even if the viscosity of the bulk differs and are each configured so as not to cause the liquid leakage have been requested.

CITATION LIST

Patent Literature

Patent Literature 1: Japanese Unexamined Patent Application Publication No. 11-48678

Patent Literature 2: Japanese Unexamined Patent Application Publication No. 2013-102910

Patent Literature 3: Japanese Unexamined Patent Application Publication No. 2004-344858

Technical Problem

Thus, an applicator according to the present invention has been invented to solve the conventional problems and an object of the present invention is to provide an applicator configured as follows. Even if a plurality of kinds of liquid applying materials of different viscosities and materials accumulated inside are present or amounts of accumulation of the liquid applying material accumulated in the storage variously differ, the applicator can handle the plurality of kinds of liquid applying materials. Moreover, the applicator with identical shape and identical size can handle the plurality of kinds of the liquid applying materials including the case of different amount of accumulation. Further, the object of the present invention is to provide an applicator configured as follows. Even if a plurality of kinds of the liquid applying materials, namely, bulk liquid, of different viscosities and materials accumulated inside are present or the amounts of accumulation of the liquid applying material accumulated in the storage variously differ, the applicator can handle the plurality of kinds of bulk liquid. Further, even if respective viscosities of the bulk liquid differ, an applicator of identical standard can be used so as not to cause a liquid leakage.

SUMMARY OF INVENTION

An applicator includes an approximately cylindrical-shaped body, an application member, a storage, and a liquid applying material absorbing body. The application member is housed inside the body. The storage accumulates a liquid applying material impregnated into the application member. The liquid applying material absorbing body adjusts an amount of the impregnation of the liquid applying material to the application member. The storage is configured to increase and reduce an accumulation region for the liquid applying material.

Alternatively, an applicator according to the present invention includes an approximately cylindrical-shaped body, an application member, a storage, and a liquid applying material absorbing body. The application member is housed inside the body. The storage accumulates a liquid applying material impregnated into the application member. The liquid applying material absorbing body adjusts an amount of the impregnation of the liquid applying material to the application member. The liquid applying material absorbing body has a changeable size to ensure increasing and reducing the amount of impregnation of the liquid applying material.

Alternatively, an applicator includes a tube-shaped body, an application member, a storage, a liquid applying material absorbing body, and a compression member. The application member is housed inside the body. The storage accumulates a liquid applying material impregnated into the application member. The liquid applying material absorbing body adjusts an amount of the impregnation of the liquid applying material to the application member. The compression member compresses the liquid applying material absorbing body disposed inside the body in the body.

The compression member has a structure by which a degree of the compression of the liquid applying material absorbing body inside the body is changeable and the amount of impregnation of the liquid applying material impregnated into the application member is adjustable.

Alternatively, the liquid applying material absorbing body is constituted of a foam material internally having an open cell structure.

Alternatively, the storage internally includes a ball for stirring.

Advantageous Effects of Invention

With the applicator according to the present invention, even if a plurality of kinds of liquid applying materials of different viscosities and materials accumulated inside are present or the amounts of accumulation of the liquid applying material accumulated in the storage variously differ, the applicator can handle the plurality of kinds of liquid applying materials. Moreover, the applicator with identical shape and identical size can handle the plurality of kinds of the liquid applying materials including the case of different amount of accumulation. Further, even if a plurality of kinds of the liquid applying materials of different viscosities and materials accumulated inside are present or the amounts of accumulation of the liquid applying material accumulated in the storage variously differ, the applicator can handle the plurality of kinds of liquid applying materials. Further, even if respective viscosities of bulk liquid differ, an applicator of identical standard can be used so as not to cause the liquid leakage. Thus, the present invention can provide the excellent effects.

BRIEF DESCRIPTION OF DRAWINGS

FIGS. 8A and 8B are tables describing results of a swing inspection after liquid filling.

DESCRIPTION OF EMBODIMENTS

Figure 1:
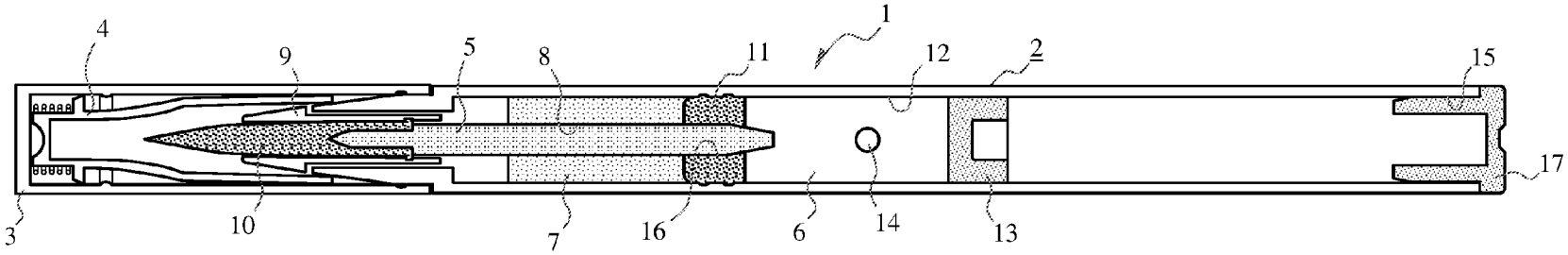
FIG. 1 is an explanatory view (1) describing a configuration of an applicator according to a first embodiment of the present invention.
Figure 2:
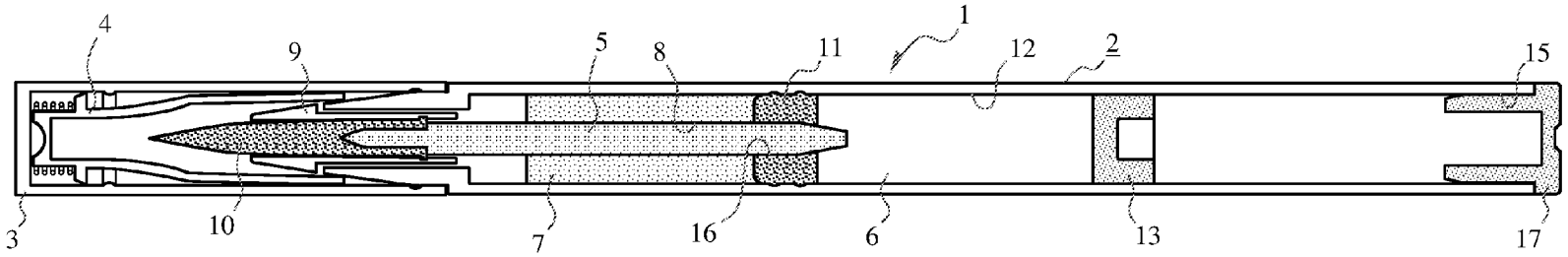
FIG. 2 is an explanatory view (2) describing the configuration of the applicator according to the first embodiment of the present invention.

The following describes the present invention based on embodiments illustrated in the drawings.

FIG. 1 is a configuration explanatory view describing a configuration of an applicator 1 according to a first embodiment of the present invention.

The applicator 1 according to the first embodiment of the present invention includes an approximately cylindrical-shaped body 2.

The applicator 1 also includes a cap 3 and an inner cap 4.

The body 2 internally holds a core-like application member 5.

This application member 5 is usually made of a fiber member such that a liquid applying material 6, which will be described later, can be gradually impregnated by, for example, capillarity.

An absorbing body 7 is used.

As understandable from FIG. 1, this absorbing body 7 is formed into a columnar shape whose outer peripheral surface has no concavo-convex shape. The absorbing body 7 includes an axially-extending through-hole 8 at a center in the axial direction.

The application member 5 is inserted through and mounted to this through-hole 8.

Figure 4:
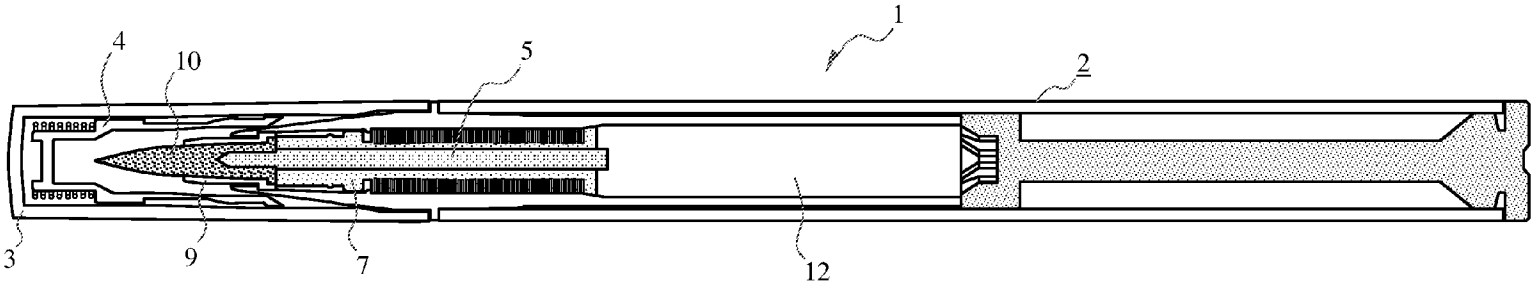
FIG. 4 is an explanatory view describing a configuration of a conventional applicator.
Figure 5:
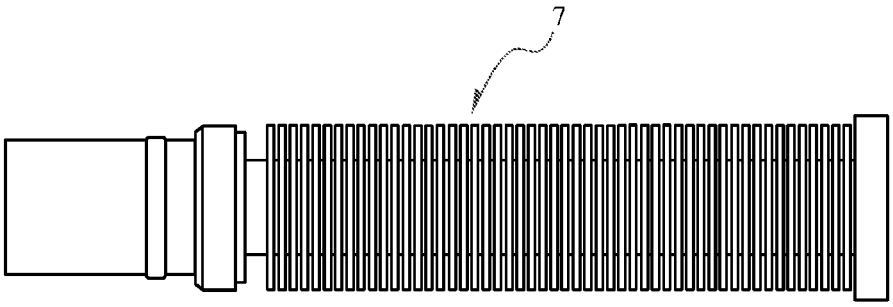
FIG. 5 is an explanatory view describing a configuration of a conventional absorbing body.

Conventionally, as illustrated in FIG. 4 and FIG. 5, this absorbing body 7 has been manufactured with a resin molded product whose outer periphery has been configured as an uneven surface in an accordion shape. However, as described above, the cost taken for the mold is high. Therefore, manufacturing the absorbing bodies 7 with a plurality of different kinds of forms resulted in the expensive cost of the applicator itself.

Accordingly, the absorbing body 7 of the present invention is formed of a flexible member with impregnation force such as polyurethane. Easily cutting a size and a length of the absorbing body 7 can change the absorbing body 7.

A nose piece 9 is used. The nose piece 9 holds a distal end side of the core-like application member 5 and is fixedly secured to a tip end of the body 2.

A drawing member 10 is fitted onto and mounted to the distal end side of the application member 5. This drawing member 10 performs a drawing or an application with the impregnated liquid applying material 6.

Next, a plug 11 is used. The plug 11 causes a rear end side of the application member 5 to be inserted through the inside of the body 2 and holds the application member 5. The plug 11 causes a rear end portion of the application member 5 to be exposed to a storage 12, which is formed adjacent to the plug 11.

Figure 3A:
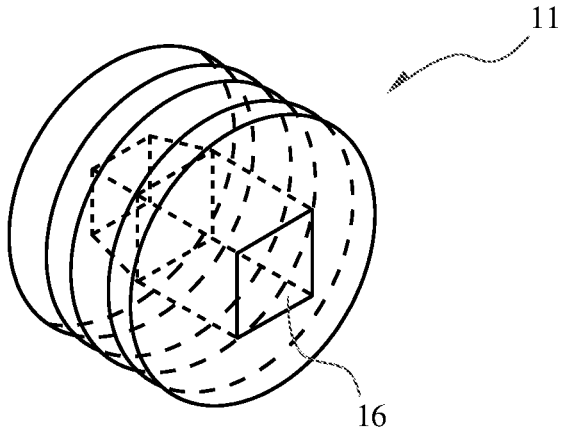
FIGS. 3A and 3B are an explanatory views describing a configuration of a plug.
Figure 3B:
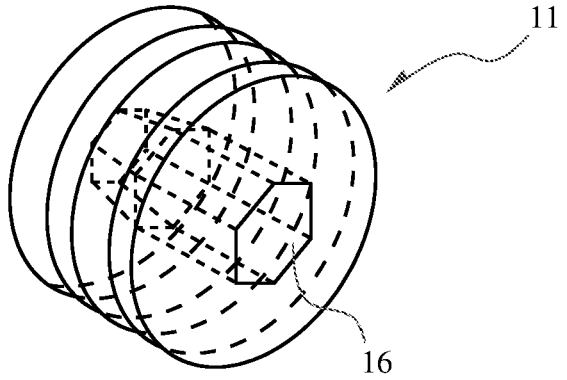

As understood from FIG. 3, as described above, the plug 11 causes the rear end side of the application member 5 to be inserted through the inside of a through-hole 16 to hold the application member 5. A shape of this through-hole 16 is formed into a different shape such as a square or a hexagonal shape.

This configuration is made aiming to adjust a width of a clearance between the through-hole 16 and the application member 5, which is inserted through the through-hole 16, according to the viscosity and the material of the liquid applying material 6 and to adjust an amount of the liquid applying material 6 infiltrated to the absorbing body 7.

Here, the storage 12 accumulates the liquid applying material 6.

A stop plug 13 to form the storage 12 is used.

Thus, this stop plug 13 is mountable to any position of the body 2 in a longitudinal direction; therefore, a region for the storage 12 can be easily changed.

A ball 14 is used. After the storage 12 accumulates the liquid applying material 6, putting this ball 14 into this storage 12 allows accelerating the impregnation of the liquid applying material 6 into the application member 5; thereby ensuring fully use of the liquid applying material 6 to the end.

The applicator 1 without a ball 14 exists.

With the above-described configuration, the following describes an assembly of the applicator 1. First, the body 2 internally includes the drawing member 10 via the nose piece 9 at the distal end. The core-like application member 5 is mounted to the rear end side of the drawing member 10 to which the absorbing body 7, which is cut to a desired length, and the plug 11 are mounted.

Afterwards, the liquid applying material 6 is filled in the storage 12, which is configured to be the desired region space, from a rear end opening 15 of the body 2. The storage 12 is lidded with the stop plug 13 to accumulate the liquid applying material 6 in the storage 12.

Afterwards, the rear end of the body 2 is lidded with a tail plug 17 to terminate the assembly.

Next, the following describes a second embodiment of the present invention.

Figure 6:
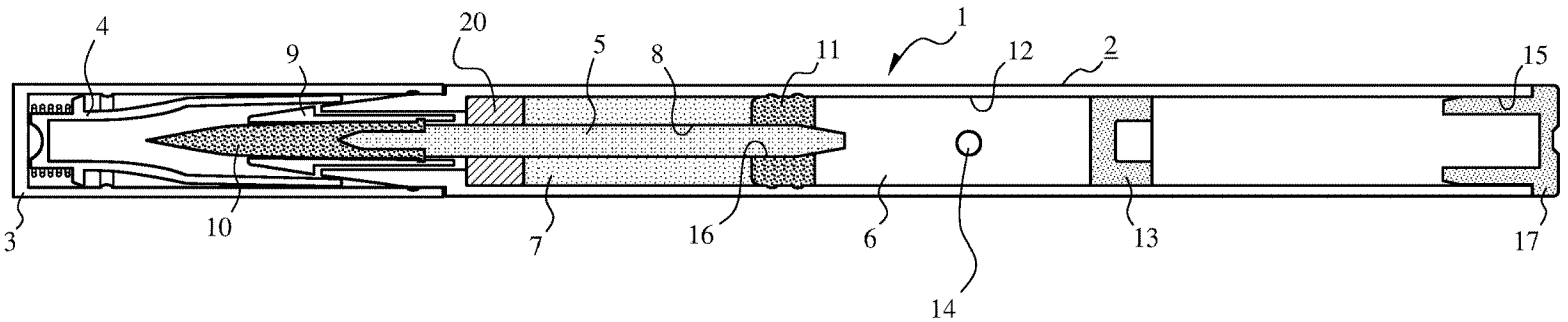
FIG. 6 is an explanatory view (1) describing a configuration of an applicator according to a second embodiment of the present invention.
Figure 7:
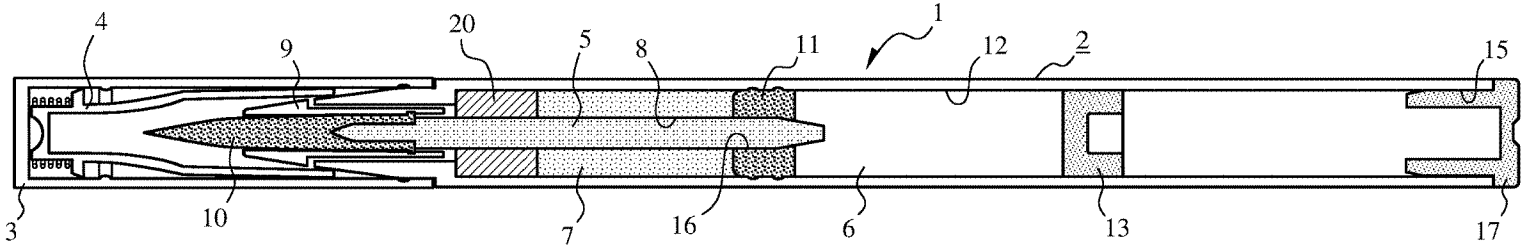
FIG. 7 is an explanatory view (2) describing the configuration of the applicator according to the second embodiment of the present invention.

FIG. 6 and FIG. 7 are configuration explanatory views describing configurations of the applicator 1 according to the second embodiment.

Similar to the applicator 1 of the first embodiment, the applicator 1 of the second embodiment also includes the approximately cylindrical-shaped body 2, the cap 3, and the inner cap 4.

The body 2 internally holds the core-like application member 5.

This application member 5 is usually made of a fiber member such that the liquid applying material 6, which will be described later, can be gradually impregnated by, for example, capillarity.

As understandable from FIG. 6 and FIG. 7, this absorbing body 7 is formed into a columnar shape whose outer peripheral surface has no concavo-convex shape. The absorbing body 7 includes the through-hole 8, which is inserted through in the axial direction, at the center in the axial direction.

The application member 5 is inserted through and mounted to this through-hole 8.

Thus, the absorbing body 7 is, for example, constituted of the flexible member with the impregnation force such as a foam material that internally has open cells. Easily cutting the size and the length of the absorbing body 7 can change the shape.

The nose piece 9 is used. The nose piece 9 holds the distal end side of the core-like application member 5 and is fixedly secured to the tip end of the body 2.

The drawing member 10 is fitted onto and mounted to the distal end side of the application member 5. This drawing member 10 performs the drawing or the application with the impregnated liquid applying material 6.

Next, the plug 11 is used. The plug 11 causes the rear end side of the application member 5 to be inserted through the inside of the body 2 and holds the application member 5. The plug 11 causes the rear end portion of the application member 5 to be exposed to the storage 12, which is formed adjacent to the plug 11.

As described above, the plug 11 causes the rear end side of the application member 5 to be inserted through the inside of the through-hole 16 to hold the application member 5. The shape of this through-hole 16 is formed into the different shape such as the square or the hexagonal shape.

This configuration is made aiming to adjust the width of the clearance between the through-hole 16 and the application member 5, which is inserted through the through-hole 16, according to the viscosity and the material of the liquid applying material 6 and to adjust the amount of the liquid applying material 6 infiltrated to the absorbing body 7.

Here, the storage 12 accumulates the liquid applying material 6.

The stop plug 13 to form the storage 12 is used.

Thus, this stop plug 13 is mountable to any position of the body 2 in the longitudinal direction; therefore, the region for the storage 12 can be easily changed.

The ball 14 is used. After the storage 12 accumulates the liquid applying material 6, putting this ball 14 into this storage 12 allows accelerating the impregnation of the liquid applying material 6 into the application member 5; thereby ensuring fully use of the liquid applying material 6 to the end.

The applicator 1 without the ball 14 exists.

Next, with the second embodiment, the following describes the assembly of the applicator 1. First, the body 2 internally includes the drawing member 10 via the nose piece 9 at the distal end. The core-like application member 5 is mounted to the rear end side of the drawing member 10 to which the absorbing body 7, which is cut to a desired length, and the plug 11 are mounted.

Afterwards, the liquid applying material 6 is filled in the storage 12, which is configured to be the desired region space, from the rear end opening 15 of the body 2. The storage 12 is lidded with the stop plug 13 to accumulate the liquid applying material 6 in the storage 12.

Afterwards, the rear end of the body 2 is lidded with the tail plug 17 to terminate the assembly.

The viscosity of the liquid applying material 6 depends on the kind of the liquid applying material 6; therefore, with the liquid applying material 6 with small viscosity, a liquid leakage has possibly occurred from the drawing member 10 mounted to the distal end of the application member 5.

However, to prevent this liquid leakage, although the applicators have been configured by differentiating the length of the absorbing bodies 7 and differentiating the size of the storages 12, only this configuration failed to finally solve the liquid leakage.

Therefore, this embodiment has configured the following applicator 1 of the present invention. The applicators 1 can be constituted of the one kind of the applicators 1 that do not cause the liquid leakage according to the bulk viscosities of respective kinds even if the applicator 1 where the absorbing body 7 designed to be the identical size (length) and the storage 12 designed to be the identical size are incorporated.

That is, the body 2 internally includes a compression member 20. The compression member 20 compresses the absorbing body 7, which is housed in the body 2 of the applicator 1, to change the size (length) of the absorbing body 7.

The absorbing body 7 is, as described above, formed of the foam material that internally has open cells.

As understood from the drawing, this absorbing body 7 has the through-hole 8 through which the application member 5 axially passes.

As illustrated in FIG. 6 and FIG. 7, mediating the compression member 20 on one side of the absorbing body 7 compresses the absorbing body 7 in the longitudinal direction by the length of the mediated compression member 20.

That is, with the absorbing body 7 with a length of 20 mm, mediating the compression member 20 with a length of 4 mm compresses the absorbing body 7 to the length of 16 mm, thus shortening the absorbing body 7.

Compressing the absorbing body 7, which is formed of the foam material internally having open cells, increases adhesiveness with the application member 5 inserted through the through-hole 8. This suctions up the liquid applying material 6 penetrated to the application member 5 by capillarity.

Accordingly, the extra liquid applying material 6 is not impregnated into the application member 5 and the drawing member 10, thereby ensuring preventing the liquid leakage of the liquid applying material 6.

FIG. 8 illustrates the experimental results.

In FIG. 8, the three applicators 1 with similar configuration were created as a sample 1, a sample 2, and a sample 3. A swing inspection test was conducted on the respective samples with no compression member 20, with the compression member 20 with a length of 4 mm, and the compression member 20 with the length of 5.5 mm after the liquid applying material 6 was filled.

The swing inspection is an inspection that holds the applicator 1 and vertically swings the held applicator 1 several times.

This inspection inspected the number of swings at which the liquid leakage occurred.

The viscosity of the liquid applying material 6 was designed to be 6.0 CP (centipoise).

Then, as shown in FIG. 8, among the samples with no compression member 20, swinging the sample 1 and the sample 2 six times caused the liquid leakage, and swinging the sample 3 five times caused the liquid leakage.

In the case where the samples included the 4-mm compression member 20 inside the body 2 and the absorbing body 7 was compressed, swinging the sample 1 eight times caused the liquid leakage, swinging the sample 2 seven times caused the liquid leakage, and swinging the sample 3 nine times caused the liquid leakage.

Furthermore, in the case where the samples included the compression member 20 with the length of 5.5 mm and the absorbing body 7 was compressed, swinging the sample 1 twelve times caused the liquid leakage, swinging the sample 2 eleven times caused the liquid leakage, and swinging the sample 3 thirteen times caused the liquid leakage.

Next, the viscosity of the liquid applying material 6 was changed to 5.0 CP (centipoise) and the test was conducted again.

In the samples with no compression member 20, swinging the sample 1, the sample 2, and the sample 3 four times caused the liquid leakage.

In the case where the samples included the compression member 20 with the length of 4 mm and the absorbing body 7 was compressed, swinging the sample 1 six times caused the liquid leakage, swinging the sample 2 seven times caused the liquid leakage, and swinging the sample 3 six times caused the liquid leakage.

Furthermore, in the case where the samples included the compression member 20 with the length of 5.5 mm and the absorbing body 7 was compressed, swinging the sample 1 and the sample 2 ninth times caused the liquid leakage, and swinging the sample 3 ten times caused the liquid leakage.

Thus, compressing the absorbing body 7 in the longitudinal direction with the compression member 20 to increase the adhesiveness with the application member 5 does not penetrate the extra liquid applying material 6 to the application member 5 and the absorbing body 7 absorbs the extra liquid applying material 6.

Consequently, it has proved that the applicator 1 of the present invention does not cause the liquid leakage.

REFERENCE SIGNS LIST

1 applicator
2 body
3 cap
4 inner cap
5 application member
6 liquid applying material
7 absorbing body
8 through-hole
9 nose piece
10 drawing member
11 plug
12 storage
13 stop plug
14 ball
15 rear end opening
16 through-hole
17 tail plug
20 compression member

What is claimed is:

1. An applicator comprising:

a main body;

an application member;

a storage configured to accumulate a liquid applying material to be impregnated into the application member;

a liquid applying material absorbing body configured to adjust an amount of impregnation of the liquid applying material into the application member;

a drawing member;

a nose piece;

a first plug;

a second plug; and a third plug, wherein:

the application member is housed inside the main body;

the first plug, the second plug, and the third plug are mounted directly to the main body;

the second plug is a stop plug between the first plug and the third plug;

the third plug is a tail plug which covers a rear end opening of the main body;

the storage is defined between the first plug and the second plug;

the liquid applying material absorbing body includes a through-hole;

the first plug includes a through-hole;

the application member extends through the through-hole of the liquid applying material absorbing body and the through-hole of the first plug;

the drawing member is mounted to a distal end side of the application member; and the nose piece holds the distal end side of the application member and is fixedly secured to a tip end of the main body.

2. The applicator according to claim 1, wherein the liquid applying material absorbing body is constituted of a foam material internally having an open cell structure.

3. The applicator according to claim 1, wherein the storage internally includes a ball for stirring.

4. The applicator according to claim 1, wherein the main body is cylindrical.

5. The applicator according to claim 1, further comprising:

an outer cap; and an inner cap, wherein the outer cap and the inner cap are mounted to the main body.

6. An applicator comprising:

a main body;

an application member;

a storage configured to accumulate a liquid applying material to be impregnated into the application member;

a liquid applying material absorbing body configured to adjust an amount of impregnation of the liquid applying material into the application member;

a drawing member;

a nose piece;

a first plug;

a second plug; and a third plug, wherein:

the application member is housed inside the main body;

the first plug, the second plug, and the third plug are mounted directly to the main body;

the second plug is a stop plug between the first plug and the third plug;

the third plug is a tail plug which covers a rear end opening of the main body;

the storage is defined between the first plug and the second plug;

the liquid applying material absorbing body includes a through-hole;

the first plug includes a through-hole;

the application member extends through the through-hole of the liquid applying material absorbing body and the through-hole of the first plug;

the drawing member is mounted to a distal end side of the application member;

the nose piece holds the distal end side of the application member and is fixedly secured to a tip end of the main body; and the liquid applying material absorbing body is cuttable.

7. The applicator according to claim 6, wherein the liquid applying material absorbing body is constituted of a foam material internally having an open cell structure.

8. The applicator according to claim 6, wherein the storage internally includes a ball for stirring.

9. The applicator according to claim 6, wherein the main body is cylindrical.

10. The applicator according to claim 6, further comprising:

an outer cap; and an inner cap, wherein the outer cap and the inner cap are mounted to the main body.

11. An applicator comprising:

a main body;

an application member;

a storage configured to accumulate a liquid applying material to be impregnated into the application member;

a liquid applying material absorbing body configured to adjust an amount of impregnation of the liquid applying material into the application member;

a compression member configured to compress the liquid applying material absorbing body inside the main body;

a drawing member;

a nose piece;

a first plug;

a second plug; and a third plug, wherein:

the application member is housed inside the main body;

the first plug, the second plug, and the third plug are mounted directly to the main body;

the second plug is a stop plug between the first plug and the third plug;

the third plug is a tail plug which covers a rear end opening of the main body;

the storage is defined between the first plug and the second plug;

the liquid applying material absorbing body includes a through-hole;

the first plug includes a through-hole;

the application member extends through the through-hole of the liquid applying material absorbing body and the through-hole of the first plug;

the drawing member is mounted to a distal end side of the application member; and the nose piece holds the distal end side of the application member and is fixedly secured to a tip end of the main body.

12. The applicator according to claim 11, wherein the liquid applying material absorbing body is constituted of a foam material internally having an open cell structure.

13. The applicator according to claim 11, wherein the storage internally includes a ball for stirring.

14. The applicator according to claim 11, wherein the main body is tube-shaped.

15. The applicator according to claim 11, further comprising:

an outer cap; and an inner cap, wherein the outer cap and the inner cap are mounted to the main body.

* * * * *